US005328332A

United States Patent [19]

Chiang

[11] Patent Number: 5,328,332

[45] Date of Patent: Jul. 12, 1994

[54] WHEEL FAN OF RANGE HOOD

[76] Inventor: Swea T. Chiang, No. 410, Chung Sun Road, She Koou Tsuen, Shern Gang Shiang, Taichung Hsien, Taiwan

[21] Appl. No.: 66,370

[22] Filed: May 25, 1993

[51] Int. Cl.[5] ..... F04D 29/30

[52] U.S. Cl. ..... 416/186 R; 416/188; 416/195

[58] Field of Search ..... 416/180, 182, 185, 186 R, 416/188, 195

[56] References Cited

U.S. PATENT DOCUMENTS

| | | | |
|---|---|---|---|
| 1,676,946 | 7/1928 | Fechheimer | 416/186 R |
| 3,144,204 | 8/1964 | Bohanon | 416/186 R |
| 3,306,528 | 2/1967 | Eck | 416/186 R |

FOREIGN PATENT DOCUMENTS

| | | | |
|---|---|---|---|
| 0153221 | 8/1985 | European Pat. Off. | 416/186 R |

*Primary Examiner*—Edward K. Look
*Assistant Examiner*—Christopher Verdier
*Attorney, Agent, or Firm*—Pro-Techtor International

[57] ABSTRACT

A wheel fan of a range hood used in the kitchen having improved blades and mechanisms for locating a top plate, which includes blades, a top plate sinking inwardly like a bowl, a bottom ring, convex rings set at the side and top of the blades, and channels formed on the top plate and the bottom ring which match the convex rings, so that assembly will be simplified, and performance will be reliable with less noise.

3 Claims, 6 Drawing Sheets

WHEEL FAN OF RANGE HOOD

BACKGROUND OF THE INVENTION

1. Field of the Invention

The present invention relates a wheel fan of a range hood used in the kitchen and particularly to a wheel fan of a ventilator having improved blades and mechanisms for locating a top plate.

2. Description of the Prior Art

The wheel fan of a conventional range hood, as shown in FIG. 1, has a top cover 100A concave at its center like a bowl; rectangular blades 200A ranging radially and held by the top cover 100A; a plane circular bottom plate 300A to the bottom of the blades 200A; and centrifugal blades 400A held by a central hole on the bottom plate 300A. It performs badly and makes much noise.

The wheel fan of a conventional range hood developed later, as shown in FIG. 2, has a top plate 100B sinking inwardly, a bent bottom ring 300A, and blades 200B held by the top plate 100B and bottom plate 300B. Because the blades 200B are independent, they are connected to the bottom ring 300B and then the top plate 100B one by one, so that assembly is laborious. Furthermore, the performance is unstable due to a change of the distance between any two adjacent blades.

SUMMARY OF THE INVENTION

It is an object of the present invention to provide a wheel fan of a range hood which has a constant distance between any two adjacent blades, firm fixation, and as a result of a reliable performance.

This wheel fan has improved blades and mechanisms for locating a top plate, which comprises blades, a top plate sinking inwardly like a bowl, a bottom ring, and convex rigns set at the side and top of the blades; characterized in that: the convex rings match channels formed on the top plate and the bottom ring.

A more complete understanding of these and other features and advantages of the present invention will become apparent from a careful consideration of the following detailed description of certain embodiments illustrated in the accompanying drawings.

DESCRIPTION OF TEE PREFERRED EMBODIMENTS

A wheel fan of a range hood used in the kitchen having improved blades and mechanisms for locating a top plate comprises a wheel 1, a bottom ring 13 and a top plate 2.

Figure 1:
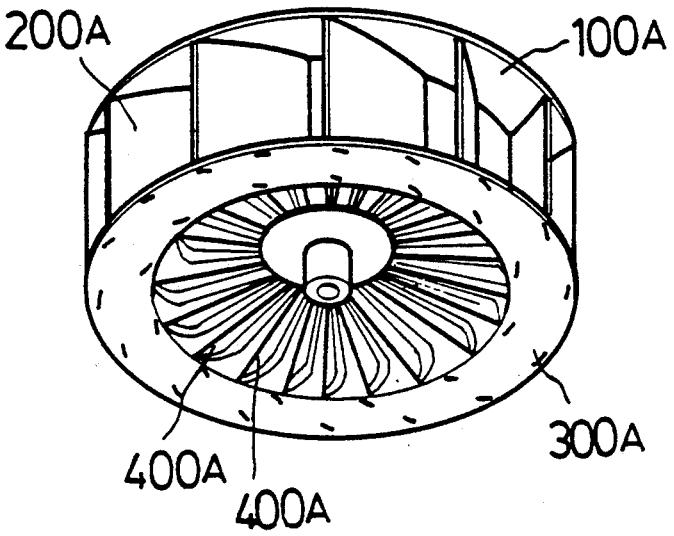
FIG. 1 (PRIOR ART)
FIG. 1 is a schematic view of a conventional wheel fan of a range hood.
Figure 2:
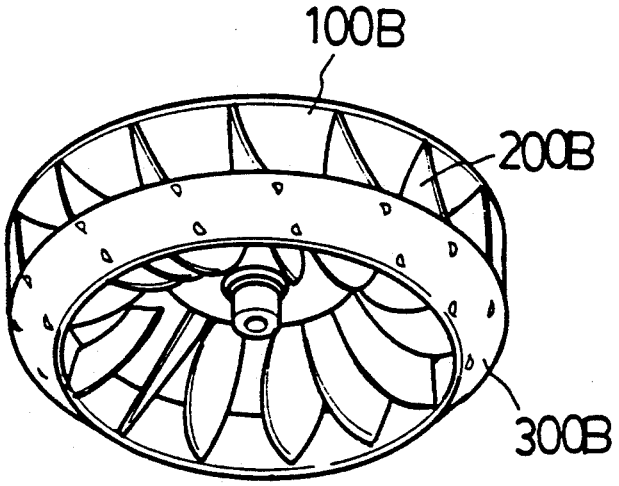
FIG. 2 (PRIOR ART)
FIG. 2 is a schematic view of another embodiment of a conventional wheel fan of a range hood.
Figure 4:
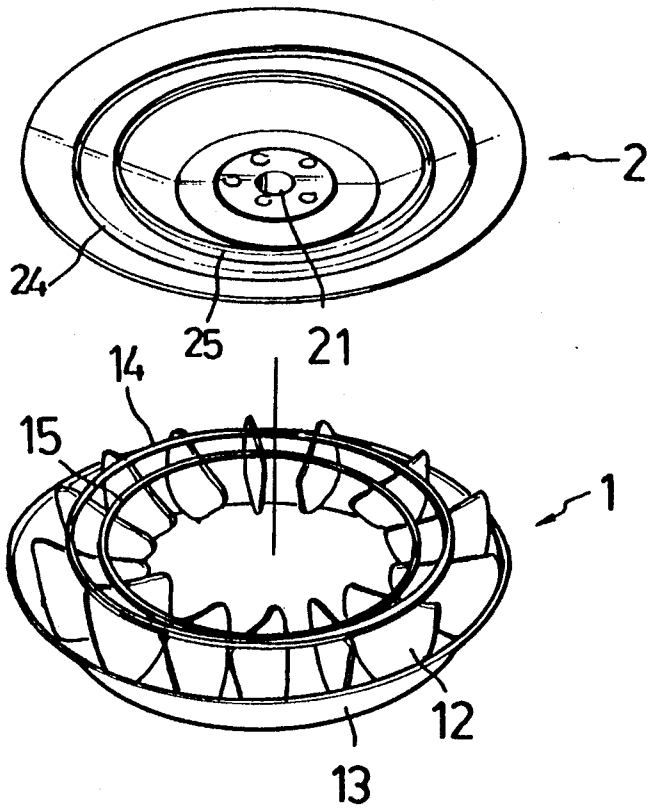
FIG. 4 is a separated view of the first embodiment of the present invention.
Figure 3:
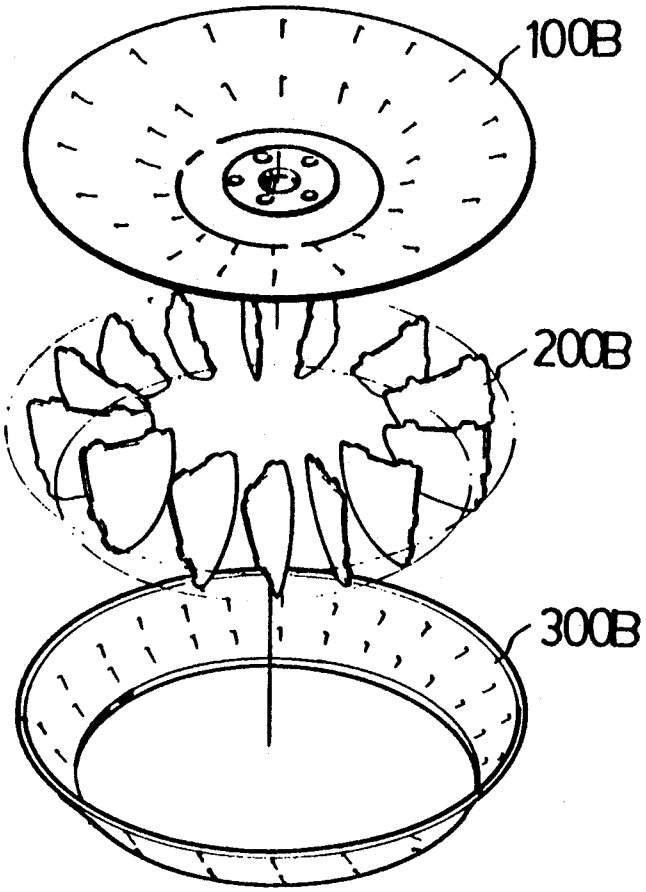
FIG. 3 (PRIOR ART)
FIG. 3 is a separated view of FIG. 2.

Referring to FIG. 4 (the first embodiment), a wheel 1 has a number of blades 12. The blades 12 and the bottom ring 13 are casted in metallic or plastic materials as a body. Convex rings 14, 15 are set at the top of the blades 12. The shape of the top plate 2 is like a bowl, wherein an axial hole 21 is formed at the center to penetrate a motor pivot. Two channels 24, 25 are formed on the top plate 2 to embed to convex rings 14, 15 therein; then the wheel 1 is joined with the top plate 2 as a body by means of point welds or high frequency waves. The resultant wheel fan has simple assembly, reliable performance and less noise.

Figure 5:
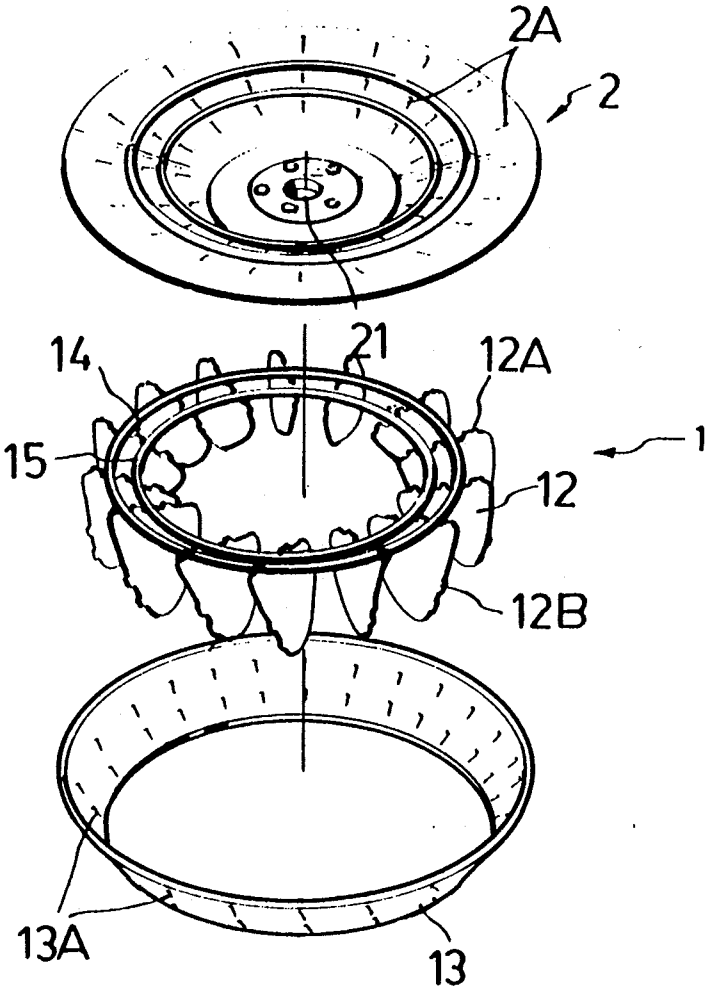
FIG. 5 is a separated view of the second embodiment of the present invention.

Referring to FIG. 5 (the second embodiment), the wheel 1 is joined with the bottom ring 13 or the top plate 2 by means of embedding ear pieces 12A, 12B formed at the side and the top of the blades 12 into holes 13A, 2A which are separately formed on the bottom ring 13 and the top plate 2. This joint is easy because of the fixed blades 12, and the matching between the convex rings 14, 15 and the channels 24, 25.

Figure 6:
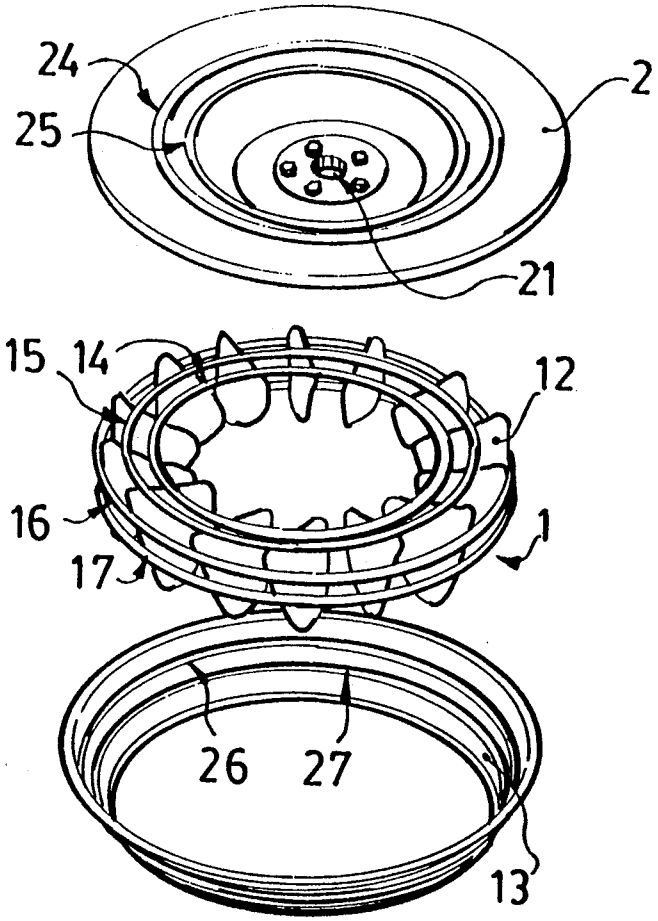
FIG. 6 is a separated view of the third embodiment of the present invention.

Referring to FIG. 6 (the third embodiment), channels 24, 25, 26, 27 are formed on the top plate 2 and the bottom ring 13 separately, and convex rings 14, 15, 16, 17 are set at the side and top of the blades 12. The blades 12 are joined to the convex rings 14, 15, 16, 17 as a body by means of point welds or high frequency waves. The resultant wheel is then joined with the bottom ring 13 and the top plate 2 by means of embedding the convex rings 14, 15, 16, 17 separately into the channels 24, 25, 26, 27 and then using point welds and high frequency waves. The resultant wheel fan also has simple assembly, reliable performance and less noise.

Figure 8:
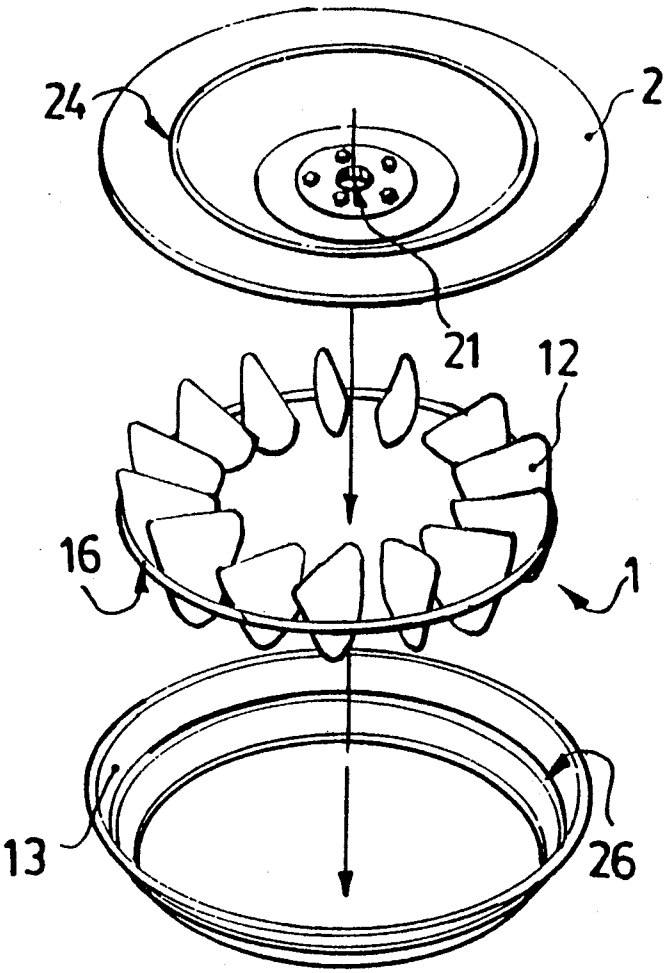
FIG. 8 is a separated view of the fifth embodiment of the present invention.
Figure 7:
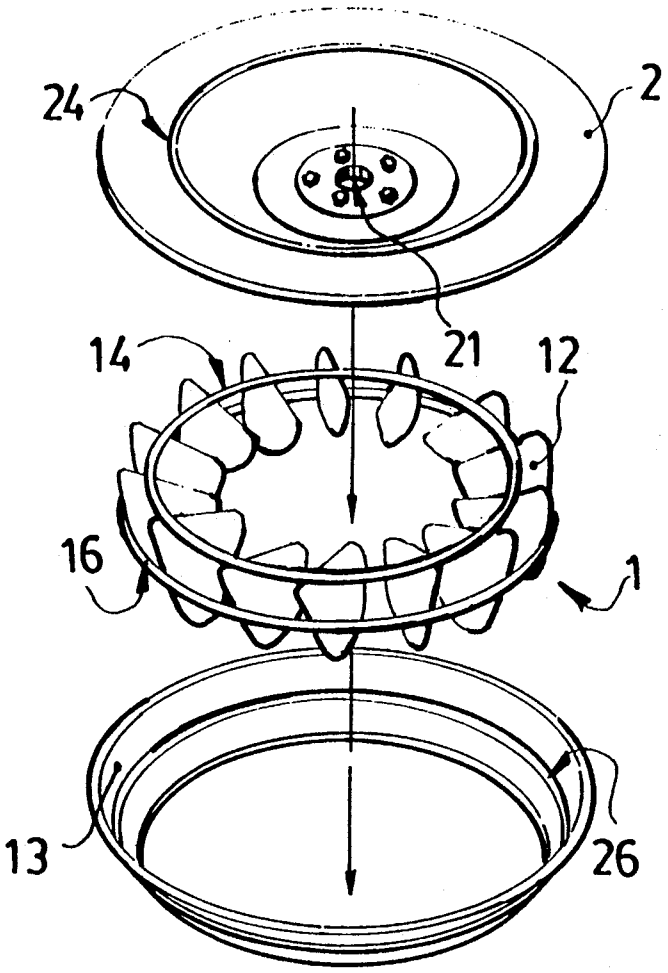
FIG. 7 is a separated view of the fourth embodiment of the present invention.
Figure 9:
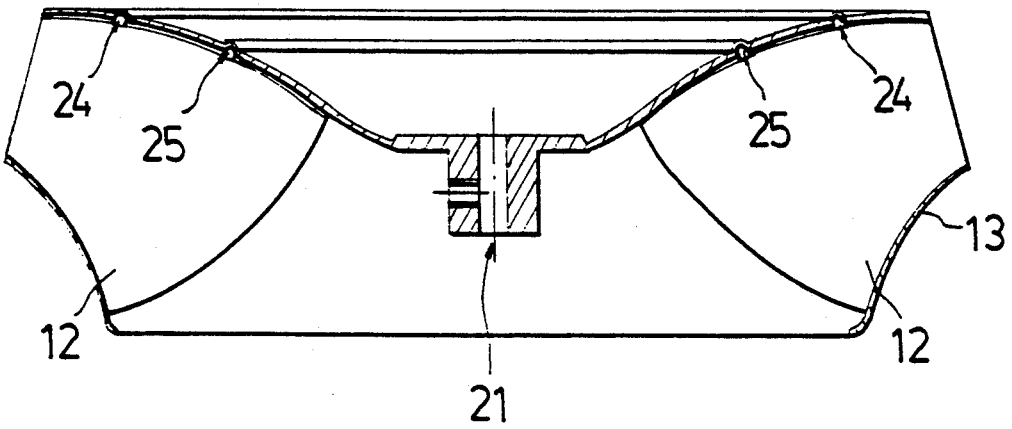
FIG. 9 is a cross-sectional view of FIG. 4 and FIG. 5.
Figure 10:
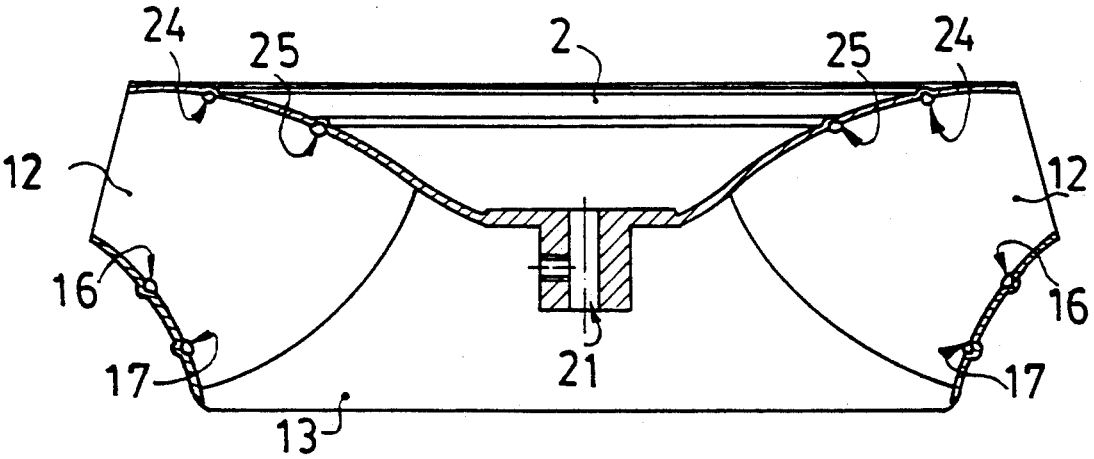
FIG. 10 is a cross-sectional view of FIG. 6.
Figure 11:
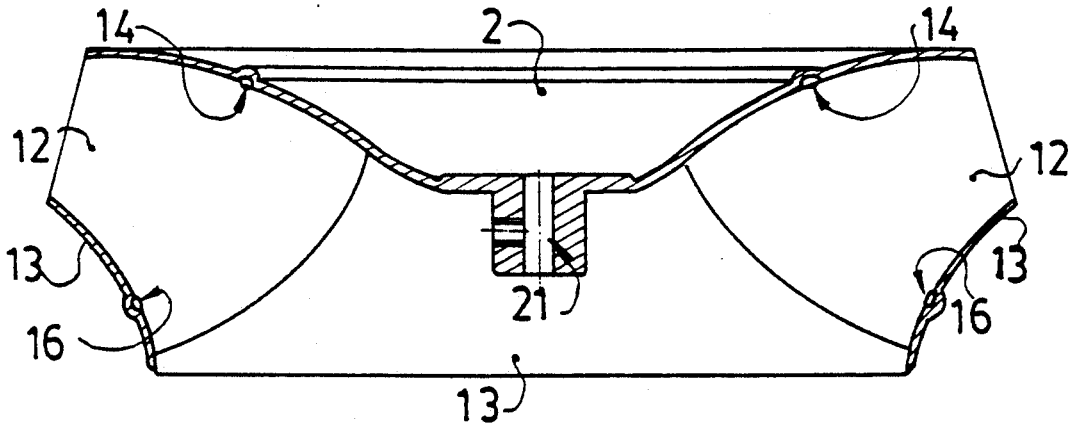
FIG. 11 is a cross-sectional view of FIG. 7.
Figure 12:
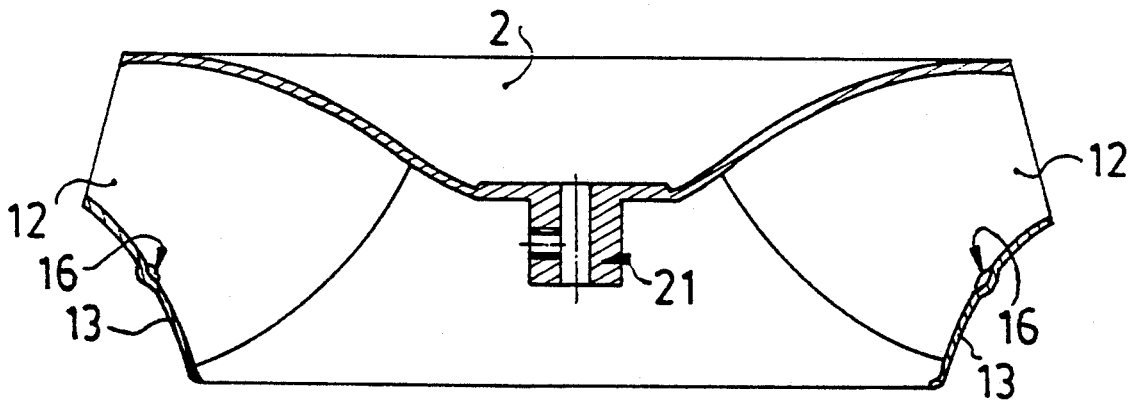
FIG. 12 is a cross-sectional view of FIG. 8.

Referring to FIG. 7 and FIG. 8 (the fourth and fifth embodiments), convex rings are set according to the force beared by the wheel fan. Maybe there are only two convex rings 14, 16 set at the top and side of the blades 12 as shown in FIG. 7, or only one convex ring 16 set at the bottom of the blades 12 as shown in FIG. 8.

What is claimed is:

1. A wheel fan of a range hood comprising:

blades:

a top plate with a concave, bowl-like shape;

and a bottom ring; wherein means for locating the top plate relative to the blades are provided, the locating means comprising one or more convex rings provided on the blades, the location of the rings corresponding to one or more channels in said top plate.

2. The wheel fan of claim 1 wherein:

means for locating the bottom ring relative to the blades are provided, the locating means comprising one or more convex rings provided on the blades, the location of the rings corresponding to one or more channels in said bottom ring.

3. A wheel fan of a range hood comprising:

blades;

a top plate with a concave, bowl-like shape;

and a bottom ring; wherein means for locating the bottom ring relative to the blades are provided, the locating means comprising one or more convex rings provided on the blades, the location of the rings corresponding to one or more channels in said bottom ring.

* * * * *